United States Patent [19]

Obetz et al.

[11] 3,953,339

[45] Apr. 27, 1976

[54] CONING OIL

[75] Inventors: James E. Obetz, Bernardsville; Albert R. Tarini, Dover, both of N.J.

[73] Assignee: Diamond Shamrock Corporation, Cleveland, Ohio

[22] Filed: Sept. 14, 1973

[21] Appl. No.: 397,299

[52] U.S. Cl. ..... 252/8.9; 252/8.6; 428/263; 428/267

[51] Int. Cl.[2] ..... C10M 1/24; D06M 13/20

[58] Field of Search ..... 117/139.5 F; 252/8.6, 252/37, 37.2, 8.9

[56] References Cited

UNITED STATES PATENTS

| | | | |
|---|---|---|---|
| 2,025,434 | 12/1935 | Bouhuys | 117/139.5 F |
| 2,291,384 | 7/1942 | Flaxman | 252/37 |
| 2,380,893 | 7/1945 | Zimmer et al. | 252/37 |
| 2,489,300 | 11/1949 | Leyda | 252/37 |
| 2,794,779 | 6/1957 | Cardwell et al. | 252/8.55 |
| 2,818,386 | 12/1957 | Francis et al. | 252/37 |
| 2,836,562 | 5/1958 | Ambrose et al. | 252/37.2 |
| 2,978,411 | 4/1961 | Leverberg et al. | 252/37 |
| 2,981,128 | 4/1961 | Flemming | 252/37 |
| 3,039,895 | 6/1962 | Yuk | 117/139.5 F |
| 3,277,000 | 10/1966 | Chandler | 117/139.5 F |

*Primary Examiner*—Herbert B. Guynn
*Attorney, Agent, or Firm*—Leslie G. Nunn; Neal T. Levin

[57] ABSTRACT

An improved coning oil to reduce oil slinging during yarn processing is obtained by adding an aluminum soap of a saturated fatty acid having from about 8 to about 22 carbon atoms to a coning oil composition containing a mineral oil and at least one emulsifier.

11 Claims, No Drawings

CONING OIL

BACKGROUND OF THE INVENTION

1. Field of the Invention

This invention relates to an improved coning oil for yarn to reduce slinging of the oil during application to yarn and in subsequent yarn processing.

2. Description of the Prior Art

Coning oils are used extensively by yarn processors also known as throwsters. The primary functions of a coning oil are to provide lubrication of the yarn and to build a good cone of yarn, the ideal supply package for most textile processing operations. A good cone is one that is not too hard or too soft. It is uniform in density and similar to other cones wound on different spindles. A good cone releases its yarn in a uniform manner in the next operation, that is, on a knitting creel, warping creel or braiding creel. Because of its particular coning oil, a good cone enhances subsequent knitting, warping and braiding operations.

With the increased consumption of bulked yarns for the knitting industries, fiber producers are utilizing modern false twist texturing equipment. This is primarily a draw-textured yarn and the coning oil is applied after texturing on this equipment and yarn supplied to the converter or throwster for subsequent knitting operations.

Throwsters are also obtaining partially drawn yarn and utilizing texturing equipment, whereby the coning oil is applied on this same equipment and supplied to knitters ready for processing.

Currently polyester and nylon are the predominant fibers for knitted fabrics. However, other fibers as rayon, acetate, triacetate, acrylic, olefin, modified nylon or blends of these may increase in use as fashion dictates. The use of a low slinging coning oil, as defined within the scope of this invention is applicable to any of the above fibers.

Coning oils are balanced products. They must be formulated to meet critical requirements such as uniform viscosity, color, odor, stability, fiber-to-metal lubrication, fiber-to-fiber lubrication, antistatic effect and scourability. Chemically, coning oils are carefully controlled blends of a mineral oil and at least one emulsifier and may contain other additives such as fiber cohesive and antistatic agents.

For many years, yarn processors had problems with the slinging of coning oil during yarn processing. Not only is the slinging of coning oil wasteful but the slung oil creates safety hazards such as slippery walking surfaces in the vicinity of the coning machines and breathing or skin discomfort where slung droplets explode into a fine mist which contaminates the entire working area. Various mechanical solutions to oil slinging have been proposed such as use of corrugated flooring and deflecting baffles on the coning machines. None of these mechanical solutions has been particularly effective. The best approach has been to mop the area around the coning machine constantly and to encourage the employees to be careful. Although this approach has met with limited success, production of yarns at high speeds has increased the quantities of slung oil in the vicinity of the coning machines and fogging of the atmosphere. Further, new government regulations on housekeeping in textile mills have been imposed which require that additional measures be taken to avoid the common violation "unsafe walking surfaces." These new developments have created a definite need for improvement of coning oils to reduce the slinging of the oil in the vicinity of the coning machine during yarn processing.

SUMMARY OF THE INVENTION

This invention relates to an improved coning oil for yarn to reduce slinging of the oil during yarn processing. The improved coning oil is produced by adding an aluminum soap of a saturated fatty acid having from about 8 to about 22 carbon atoms to a coning oil composition containing a mineral oil and at least one emulsifier.

PREFERRED EMBODIMENTS

The improved coning oil may be produced by adding an effective amount of one or more of the following aluminum soaps to a coning oil composition containing a mineral oil and at least one emulsifier. The quantity of aluminum soap may vary depending on the proportion of mineral oil and emulsifier present in the coning oil composition. For example, the improved coning oil may contain from about 0.70 to about 4.00 parts by weight (optimum being from 0.75 to 1.30 parts by weight) of aluminum soap, from about 10 to about 30 parts by weight of emulsifier and from about 70 to about 90 parts by weight of mineral oil.

Aluminum soaps of a saturated fatty acid having a carbon chain of from about 8 to 22 carbon atoms useful in this invention may be prepared from fatty acids such as caprylic acid, ethylhexoic acid, lauric acid, myristic acid, behenic acid, palmitic acid, stearic acid, arachidic acid, hydrogenated tallow fatty acids, erucic acid, coconut oil fatty acids and the like as well as mixtures of these acids. Many of these acids are well known articles of commerce and are available in the form of mixtures such as commercial stearic acid and lauric acid. These commercial acids are mixtures which may contain acids of varying carbon chains and minor quantities of unsaturated acids of varying carbon chains.

Aluminum soaps of these acids are primarily prepared by double decomposition reactions between sodium salts of these acids and water soluble aluminum salts such as aluminum sulfate. Preparation of these aluminum soaps are described in "The Alkaline Earth and Heavy Metal Soaps" (Rheinhold Publishing Corp., New York, New York 1946) by Stanley B. Elliot, pages 71 through 90.

The mineral oil used in the coning oil composition may be a mineral oil having a viscosity of from about 50 to 100 SUS at 100°F (38°C) with the preferred viscosity of this oil being from about 65 to 85 SUS at 100°F. Examples of useful oils include a mineral oil having the following properties:

| PHYSICAL PROPERTIES | |
|---|---|
| Viscosity SUS/100 F | 72.4 |
| Viscosity SUS/210 F | 36.7 |
| API gravity, 60 F | 34.7 |
| Specific gravity, 60 F | 0.8514 |
| Weight, molecular | 320 |
| Pour point, F | +5 |
| Volatility: | |
| % wt. loss, 22 hr at 225 F | 2.1 |
| Flash point, COC, F | 360 |
| Refractive index 20/D | 1.4696 |
| CHEMICAL PROPERTIES | |
| Molecular type analysis, Clay-gel wt % | |
| Asphaltenes | 0 |
| Polar compounds | 0.3 |

-continued

| | |
|---|---|
| Aromatics | 11.5 |
| Total aromatics | 11.8 |
| Saturates | 88.2 |
| Carbon type analysis, % | |
| Aromatic | 4 |
| Naphthenic | 30 |
| Paraffinic | 66 |
| Aniline point, F | 207 |

The emulsifier may be any oil soluble anionic or nonionic surfactant having a suitable HLB number. The oil soluble emulsifier may be a mixture of one or more surfactants which form a compatible formulation with the mineral oil. Useful anionic surfactants include saturated and unsaturated fatty acids. Useful nonionic emulsifiers include ethoxylated alcohols, ethoxylated saturated or unsaturated fatty acids, ethoxylated alkyl phenols and the like. Oil soluble polyethylene glycol ethers obtained by the reaction of $C_{11-15}$ linear secondary alcohols with from about 3 to 9 moles of ethylene oxide may be used as well as oil soluble mixtures obtained by blending these ethers may be used. Likewise, oil soluble polyethylene glycol ethers of OXO alcohols having the same number of carbon atoms and ethylene oxide contents as the linear secondary alcohols and oil soluble mixtures of ethers of these OXO alcohols may be used. It may be necessary to use mixtures of emulsifiers to obtain compatible formulations with the mineral oil. If necessary, a coupling agent such as water, butyl alcohol or the monobutylether of ethylene glycol may be used. The art of blending emulsifiers and using coupling agents to obtain compatible formulations with mineral oils is well known in the art.

The coning oil composition is applied to the yarn at from about 2 to about 6% based on the weight of the fiber. Application is usually done at coning to provide yarn lubrication. The amount of the coning oil applied to the yarn will depend upon the use for which the yarn is intended. The coning oil may be applied using the lube roll on the winding machine or at some other convenient point in the process.

For a fuller understanding of the nature and objects of this invention, reference may be made to the following examples which are given merely to illustrate the invention and are not to be construed in a limiting sense. All weights, proportions and percentages are on a weight basis unless otherwise indicated. Likewise, all temperatures are °C. unless otherwise indicated.

EXAMPLE I

The coning oil compositions shown in the Table are prepared by incorporating the indicated 1% by weight of the aluminum soap additive into a coning oil composition containing the following ingredients:

| % by weight | |
|---|---|
| 1 | additive |
| 79 | mineral oil |
| 20 | emulsifier |

The mineral oil used in the compositions in the Table is a mineral oil having a 85 SUS viscosity and the emulsifier is a mixture of 12 parts by weight of Tergitol 15S3 and 8 parts by weight of Tergitol 15S9. Tergitol 15S3 and Tergitol 15S9 are commercial surfactants which are condensation products of a mixture of $C_{11-15}$ secondary linear alcohols with 3 moles and 9 moles of ethylene oxide respectively. The aluminum stearates and octoate used in the preparation of these compositions contain the following percentages WASHED ASH ($Al_2O_3$) and FREE STEARIC ACID as determined by the procedures given on page 10 of METASAP METALLIC SOAPS (Metasap Chemical Co., Newark, New Jersey, 1959):

| | WASHED ASH | FREE STEARIC ACID |
|---|---|---|
| aluminum monostearate | 9% | 6% |
| aluminum distearate | 8% | 12% |
| aluminum tristearate | 6.5% | 30% |
| aluminum dioctoate | 15–16% | — |

These stearates are prepared by the double decomposition reaction between a water soluble soap and a water soluble aluminum salt.

Each coning oil is prepared by dispersing the additive into the mineral oil, heating to 110°C to clear, cooling to about 80°C, then introducing the emulsifier mixture and agitating to obtain a compatible coning oil composition.

The compositions in the Table are evaluated as coning oils on a winding machine, Leesona 50 winder (Leesona Corp., Warwick, Rhode Island) equipped with a 3 inch diameter stainless steel lube roll and a stainless steel trough for applying the coning oil composition. The lube roll is powered by a reversible speed motor with a high/low ratio and is operated against the direction of yarn travel. The contact surface of the yarn on the lube roll is adjusted to 1 inch by means of a pigtail guide. A 150/34 textured polyester yarn with no coning oil present is wound on the winding machine using the following procedure.

The winding machine is positioned with the movable pigtail guide so that the yarn running over the lube roll assembly has a contact surface of 1 inch. Sufficient coning oil is placed in the trough so that approximately 3/8 inch of the bottom of the lube roll is immersed. An empty yarn cone weighed to the nearest 0.1 gram is placed on the winding machine and a supply package of yarn weighed to the nearest 0.1 gram is placed at the base of the machine on the creel assembly. A sheet of aluminum foil 8 inches by 8 inches which has been weighed to the nearest 0.0001 gram is placed on the winder frame at a distance of 2.25 inches from the rear of the lube roll so that the sheet is perpendicular to the floor and horizontal to the lube roll axis.

The lube roll motor is then started at a predetermined speed to apply the proper oil level to yarn (3 to 5% by weight). As soon as the oil film on the roll reaches the yarn, the winder is started and operated at a speed to lubricate 300–360 yards of yarn per minute. The machine is run for 15 minutes and stopped. The yarn supply package and the cone are weighed to the nearest 0.1 gram to obtain the percent by weight of coning oil on the fiber. The aluminum sheet is reweighed to determine the mg. of oil slung on the aluminum foil. The results obtained with each composition is shown in the Table.

TABLE

| additive (% by wt.) | % coning oil by wt. on fiber | mg. coning oil slung on aluminum foil |
|---|---|---|
| 1% aluminum monostearate | 4.5 | 4.4 |
| 1% " | 4.2 | 4.0 |
| 1% aluminum distearate | 4.2 | 1.0 |
| 1% " | 3.7 | 0.4 |
| 1% aluminum tristearate | 2.1 | 2.8 |
| 1% " | 4.0 | 1.4 |
| 1% aluminum dioctoate | 3.1 | 1.7 |

TABLE-continued

| additive (% by wt.) | % coning oil by wt. on fiber | mg. coning oil slung on aluminum foil |
|---|---|---|
| 0.1% aluminum dioctoate, 0.9% aluminum distearate | 4.0 | 3.2 |
| 0.1% aluminum dioctoate, 0.9% aluminum distearate | 2.7 | 2.1 |
| 0% additive | 5.0 | 6.1 |

EXAMPLE II

The procedure of Example I is followed using a blend of the two mineral oils, two aluminum soap additives and two emulsifiers in the coning oil composition given below:

| % by weight | |
|---|---|
| 40.0 | mineral oil, 85 SUS viscosity |
| 38.7 | mineral oil, 50 SUS viscosity |
| 0.1 | aluminum dioctoate |
| 1.2 | aluminum distearate |
| 15.0 | hexadecylphenol with 9 moles of ethylene oxide |
| 5.0 | tridecyl alcohol with 3 moles of ethylene oxide |

The following results are obtained when this coning oil is applied on a 150/34 textured polyester yarn:

| % coning oil by wt. on fiber | mg. coning oil slung on aluminum foil |
|---|---|
| 4.2 | 3.2 |

While the invention has been described with reference to certain specific embodiments thereof, it is understood that it is not to be so limited since alterations and changes may be made therein which are within the full and intended scope of the appended claims.

What is claimed is:

1. In a process of processing yarn wherein a coning oil is applied to said yarn prior to processing, the step of applying to said yarn prior to processing a coning oil composition containing a mineral oil and at least one emulsifier selected from the group consisting of oil soluble anionic surfactants and oil soluble nonionic surfactants, the improvement comprising the presence of an aluminum soap of a saturated fatty acid having from about 8 to about 22 carbon atoms in an amount effective to reduce slinging of the oil during yarn processing wherein the composition is prepared by dispersing the soap in the mineral oil, heating to 110°C to clear, cooling to about 80°C, then introducing the emulsifier and agitating to obtain a compatible coning oil composition.

2. The process of claim 1 wherein the aluminum soap is aluminum stearate.

3. The process of claim 1 wherein the aluminum soap is aluminum distearate.

4. The process of claim 1 wherein the aluminum soap is aluminum monostearate.

5. The process of claim 1 wherein the aluminum soap is aluminum tristearate.

6. The process of claim 1 wherein the aluminum soap is aluminum dioctoate.

7. The process of claim 1 wherein the aluminum soap is aluminum distearate containing 8% by weight of washed ash.

8. The process of claim 1 wherein the emulsifier is a mixture of a condensation product of $C_{11-15}$ linear alcohols with 3 moles of ethylene oxide and a condensation product of $C_{11-15}$ linear alcohols with 9 moles of ethylene oxide.

9. The process of claim 1 wherein the yarn is a polyester yarn.

10. The process of claim 1 wherein the yarn is a nylon yarn.

11. A coning oil composition containing a mineral oil, an oil soluble emulsifier which is a mixture of a condensation product of $C_{11-15}$ linear alcohols with 3 moles of ethylene oxide and a condensation product of $C_{11-15}$ linear alcohols with 9 moles of ethylene oxide, and an aluminum soap of a saturated fatty acid having from about 8 to about 22 carbon atoms in an amount effective to reduce slinging of the oil during yarn processing wherein the composition is prepared by dispersing the soap in the mineral oil, heating to 110°C to clear, cooling to about 80°C, then introducing the emulsifier and agitating to obtain a compatible coning oil composition.

* * * * *